US005140840A

United States Patent [19]

Miceli

[11] Patent Number: 5,140,840

[45] Date of Patent: Aug. 25, 1992

[54] ELECTRICAL EARRING

[76] Inventor: Joseph M. Miceli, 55 Commons Dr. Apt. #35, Shrewsbury, Mass. 01545

[21] Appl. No.: 812,700

[22] Filed: Dec. 23, 1991

[51] Int. Cl.[5] ..... A44C 7/00

[52] U.S. Cl. ..... 63/12; 362/32; 362/104

[58] Field of Search ..... 63/2, 12, ; 362/104, 362/32

[56] References Cited

U.S. PATENT DOCUMENTS

| | | | |
|---|---|---|---|
| 3,790,775 | 2/1974 | Rosenblatt | 362/104 |
| 4,009,381 | 2/1977 | Schreiber et al. | 63/2 |
| 4,101,955 | 7/1978 | Dunah | 362/104 |
| 4,186,425 | 1/1980 | Nadimi | 63/2 |
| 4,237,525 | 12/1980 | Deter | 362/104 |
| 4,271,457 | 6/1981 | Martin . | |
| 4,337,504 | 6/1982 | Simpson . | |
| 4,459,645 | 7/1984 | Glatter | 63/2 |
| 4,719,544 | 1/1988 | Smith . | |
| 4,785,642 | 11/1988 | Chin et al. | 63/2 |
| 4,791,536 | 12/1988 | James . | |
| 4,998,186 | 3/1991 | Cocca | 362/104 |
| 5,018,053 | 5/1991 | Belknap et al. | 63/12 |

*Primary Examiner*—Renee S. Luebke
*Assistant Examiner*—Michael J. Milano
*Attorney, Agent, or Firm*—Blodgett & Blodgett

[57] ABSTRACT

An electrical earring for use on a pierced earlobe. The earring includes a receptor portion for positioning on an outer part of the earlobe and which contains a light enhanced display element, such as a translucent stone. The earring also includes a transmitter portion for positioning on the inner portion of an earlobe. The transmitter portion contains a battery and an electrical lamp such as an LED which is electrically connected to the battery. An elongated light transmitting post extends from the transmitter portion through the earlobe and into the receptor portion for transmitting light from the LED to the light enhanced element of the receptor portion.

9 Claims, 2 Drawing Sheets

ELECTRICAL EARRING

BACKGROUND OF THE INVENTION

The present invention relates generally to an electrical earring having built in means for illumination for use on a pierced earlobe. The invention is particularly directed to an electrical earring which includes a light enhanced display element, such as a natural or artificial translucent or semi-translucent stone.

Many styles and designs of electrical earrings have been developed and marketed. The typical electrical earring includes a battery and a small electric lamp, such as a light emitting diode of LED. The battery is contained in a housing which is positioned against the inner surface of the earlobe. The LED is mounted on a supporting base which is positioned against the outer surface of the earlobe so that the light transmitting face of the LED faces outwardly from the earlobe. An electrically conductive post extends from the battery housing through the aperture in the earlobe and into an aperture in the supporting base. The supporting base also contains appropriate electrical contact elements which are engaged by the post to enable the LED to be energized by the battery. Since the LED is the display element of the earring, the display possibilities of the earring are seriously limited. Illumination is the only feature which the LED provides to the earring. Translucent stones have been favored through the centuries as the primary display element for earrings because of the ability of the stone to diffuse and reflect ambient light in interesting and attractive patterns of color and sparkle.

It is, therefore, a principle object of the invention to provide an electrical earring which utilizes a battery energized LED to provide light to a light enhanced display body, such as a natural or synthetic stone.

Another object of this invention is the provision of an electrical earring which utilizes a light enhanced display body, an LED, and a light transmitting post for transmitting light from the LED to the display body.

A further object of the present invention is the provision of an electrical earring which includes an LED in one portion of the earring, a light enhanced display body in another portion of the earring and a post which extends from the first portion of the earring for connection to the second portion of the earring which utilizes fiber optics for transmitting light from the LED to the display body.

A still further object of the present invention is the provision of an electrical earring which utilizes a light enhanced display body in a first portion of the earring, an LED and battery in a second portion of the earring, a light transmitting post which extends from the first body for connection to the second body and switch means for electrically connecting the battery to the LED when the post is inserted through an earlobe for connecting the two portions of the earring.

With these and other objects in view, as will be apparent to those skilled in the art, the invention resides in the combination of parts set forth in the specification and covered by the claims appended hereto.

SUMMARY OF THE INVENTION

In general, the invention consists of an electrical earring for use on a pierced earlobe which includes a receptor portion for positioning on the outwardly facing surface of an earlobe and a transmitter portion for positioning on the inwardly facing surface of an earlobe. The receptor portion includes a light enhanced display body which faces outwardly from the earlobe and a bore for receiving a post. The transmitter portion contains a battery, an LED and a light transmitting post which extends through the earlobe and into the bore of the receptor portion for transmitting light from the LED to the display body. More specifically, when the receptor and transmitter portions of the earring are connected and positioned on opposite sides of an earlobe, the LED which is normally disconnected from the battery is electrically connected to the battery for energizing the LED. The post which connects the two portions of the earring utilizes fiber optics for transmitting light from the LED to the light enhanced display body.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
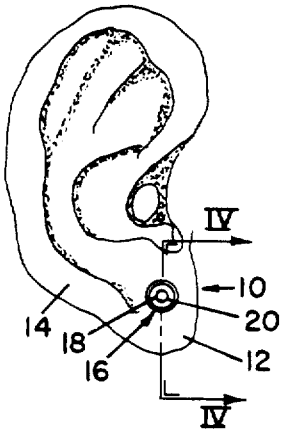
FIG. 1 is a front elevational view of an earring embodying the principles of the present invention and shown applied to an earlobe.
Figure 2:
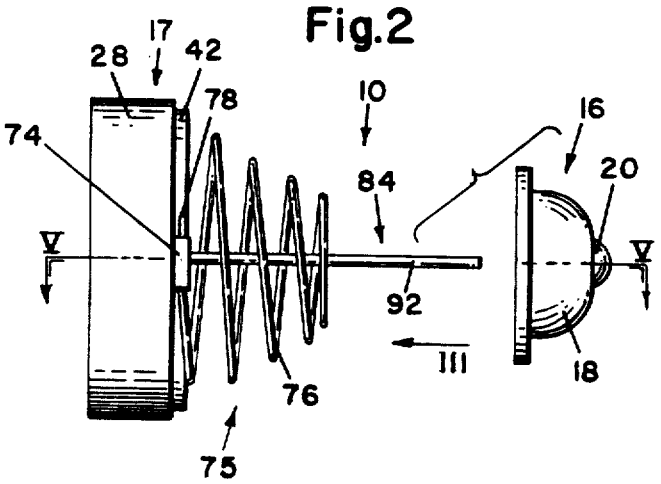
FIG. 2 is a side elevational view of the earring showing the inner and outer portions of the earring disconnected.
Figure 3:
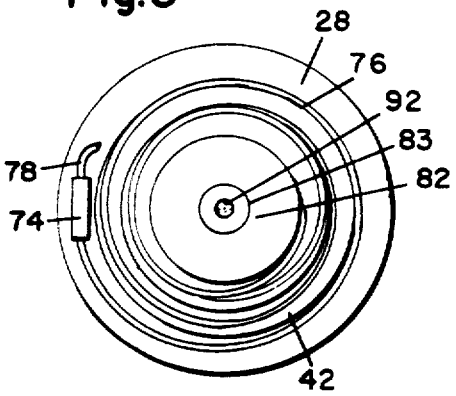
FIG. 3 is a front elevational view of the inner or transmitter portion of the earring.
Figure 4:
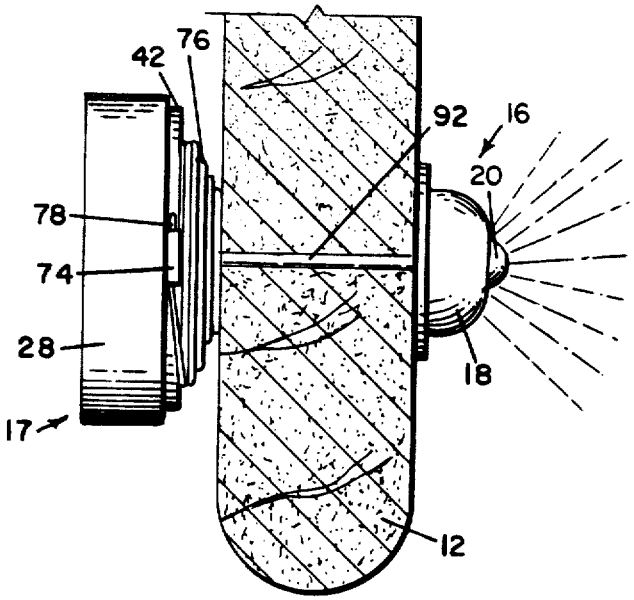
FIG. 4 is a side elevational view of the earring showing the inner and outer portions of the earring connected and applied to an earlobe.
Figure 5:
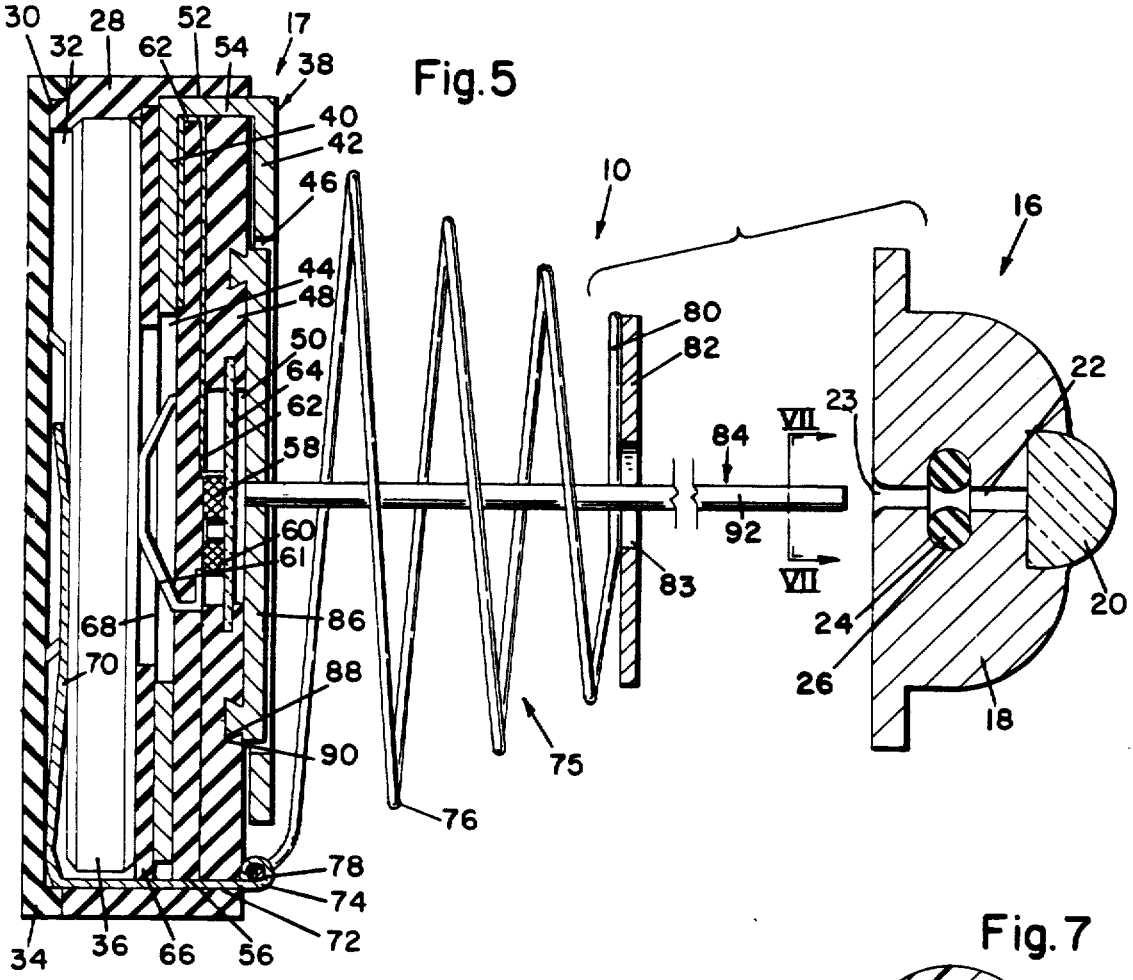
FIG. 5 is a vertical cross-sectional view of the earring taken along line V—V and looking in the direction of the arrows.
Figure 6:
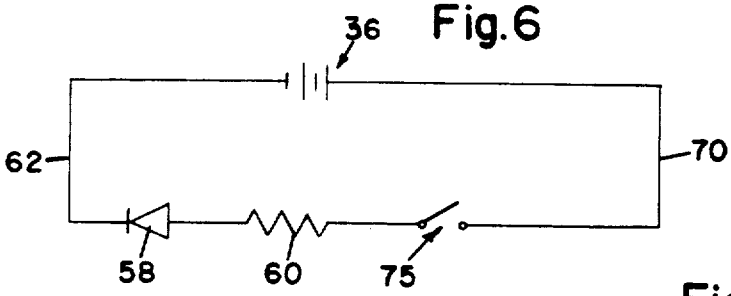
FIG. 6 is an electrical schematic view of the electrical components of the earring.

Referring first to FIG. 1, the earring of the present invention is generally indicated by the reference numeral 10 and is shown in FIG. 1 applied to an earlobe 12 of an ear 14. Referring also to FIGS. 2–5, the earring 10 comprises an outer or receptor portion which is generally indicated by the reference numeral 16 and an inner or transmitter portion which is generally indicated by the reference numeral 17. The receptor portion 16 includes a mounting body 18 and a light enhanced display element 20 of a translucent or a semi-translucent material, such as a natural or synthetic gemstone. The mounting body 18 has a bore 22, see FIG. 5, which extends from a rearwardly facing entrance opening 23 to the light enhanced display element 20 which is fixed to the outer and forward end of the mounting body 18 and projects outwardly from the body 18. The bore 22 has an annular groove 24 which contains an O-ring 26.

The transmitter portion 17 of the earring comprises a housing 28 which is made of an electrically insulating material, such as plastic. The housing 28 has a cavity 32, an inner opening 30 to the cavity and a cover 34 which is removably mounted onto the housing 28 in a snap fit for closing the inner opening 30. A replaceable battery is located within the cavity 32. The battery 36 is a small low voltage battery, such as a three-volt lithium battery. A U-shape conductor body, generally indicated by the reference numeral 38, is applied to the outer end of the housing 28, as shown more clearly in FIG. 5. The conductor body 38 includes an inner ring 40, an outer ring 42 which are connected by a leg portion 54. The inner ring 40 is located within the cavity 32 and has a central hole 44. The outer ring 42 is located outside of the body 28 and has a central hole 46. The housing 28 has a front wall 48 which has a central opening 50. The connecting leg portion 54 of the ring 38 extends through a slot 52 in the front wall 48 of the housing 28. A wafer 56 of the electrically insulating material is located between the outer wall 48 and the inner ring 40. An LED 58 and a resistor 60 are mounted on the outwardly and forwardly facing surface of the wafer 56 near the opening 50. A battery clip 61 extends from the inner surface of the wafer 56 and engages the negative side of the battery 36. The clip 61 is electrically connected to the resistor 60 which is electrically connected to the LED 58. The LED 58 is, in turn, electrically connected to the inner ring 40 by a connecting wire 62. A lens 64 extends across the opening 50 outside of the LED 58. An insulating ring 66 is located between the inner ring 40 and the battery 36. The ring 66 has a central aperture 68. The battery clip 61 extends through the aperture 44 of the inner ring 40 and the aperture 68 of the insulating ring 66 for contacting the negative side of the battery 36. A battery clip 70 engages the positive side of the battery 36 and extends through a slot 72 in the outer wall 48 of the housing. The outer end of the clip 70 is formed into a loop 74 outside of the wall 48. The LED 58 is normally disconnected from the positive side of the battery 36 and is selectively connected by switch means which is generally indicated by the reference numeral 75. Switch means 75 includes a helical coil spring 76 which is located outside of the outer ring 42. One end 78 of the spring 76 extends through the loop 74 and is either fixed to the loop 74 or anchored therewith. The outer end 80 of the spring 76 is fixed to a washer 82 which has a central aperture 83. When the spring 76 is compressed, it engages the outer ring 42 which operatively connects the LED 58 to the positive side of the battery 36 and causes the LED 58 to become energized.

When the LED 58 is energized, light is transmitted from the LED to the light enhanced element 20 by means of a fiber-optic assembly which is generally indicated by the reference numeral 84. The fiber-optic assembly 84 includes a disk 86 which has an annular inwardly-facing protrusion 88. The protrusion 88 snap fits into an annular groove 90 in the outwardly-facing surface of the outer wall 48 of the housing 28. A light transmitting post 92 extends outwardly from the disk 86 through the center of the spring 76 and through the aperture 83 in the washer 82. The post 92 is designed to be inserted into the bore 22 of the mounting body 18 so that the outer end of the post abuts the light-enhanced display element 20. The O-ring 24 helps to frictionally hold the mounting body 18 onto the post 92.

Figure 7:
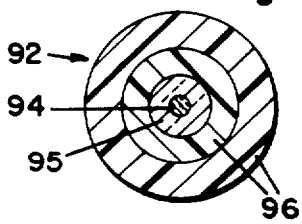
FIG. 7 is a vertical cross-sectional view of the light transmitting post portion of the earring taken along the line VII—VII of FIG. 5 looking in the direction of the arrows.

Referring particularly to FIG. 7, the post 92 consists of a conventional optical fiber which includes a glass core 94 which is embedded in a glass cladding 95. The cladding 95 is in turn encased within two layers of plastic 96.

The earring 10 of the present invention is worn in a conventional manner and is applied to the earlobe by inserting the post 92 through the aperture of the earlobe from the inner side of the ear so that the washer 82 lies against the inner surface of the earlobe. This causes the spring 76 to be compressed so that it contacts the outer ring 42, thereby connecting the LED 58 to the positive side of the battery 36 and causing the LED to be energized. The post 92 extends through the earlobe and beyond the outer surface of the earlobe. The mounting body 18 is applied to the outer surface of the earlobe so that the post 92 enters the bore 22, thereby positioning the outer end of the post 92 adjacent the light enhanced display element 20. The light from the LED 58 is focused to the end of the post 92. Light from the LED is transmitted through the post 92 by the fiber-optics within the post and emerges from the end of the post to the light enhanced body 20, thereby creating an unusual and attractive effect in the element 20.

Although the display element 20 may be of any desired size, clarity, surface texture or shape, a small size appears to derive the greatest advantage from an internal light source. It is preferred that the display element be at least partially translucent and that the element contain small differently colored imparities. The colored effect from these imparities would become more evident at a distance in a darkened room. A slight motion of the wearer's head or motion by the observer would produce an effect of changing patterns of colored light enhancing from the display element.

Figure 8:
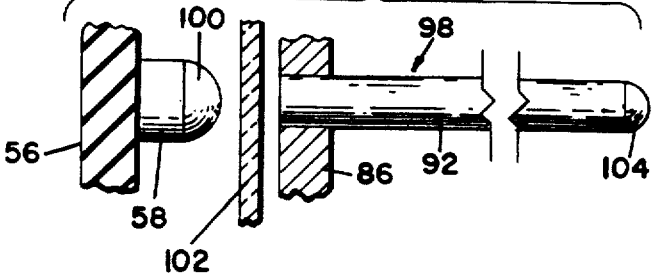
FIG. 8 is a fragmentary view of a modification in the light transmitting portions of the earring.

Referring to FIG. 8, there is shown a modified fiber-optic assembly which is generally indicated by the reference numeral 98. The fiber-optic assembly 98 includes a transparent wafer or window 102 which replaces the lens 64. A micro-lens 100 is located between the LED 58 and the wafer 102. The light emerging from an LED forms a diverging cone-like beam. The micro-lens 100 bends the light rays to form a more nearly parallel beam and focuses the parallel light rays onto the end of the fiber-core 94. The light emerging from the outer end of the fiber-core 94 also forms a diverging cone-like beam. In some cases, this condition is preferred for maximizing the enhancement of the display element 20. However, in some cases a particular display element 20 is enhanced to a greater degree by focusing the light into the element by applying a micro-lens at the outer end of the post 92, such as the micro-lens 104 as shown in FIG. 8. The micro-lens 104 can be a discreet component which is fixed to the end of the post 92 by adhesion or it can be formed at the tip of the fiber 94 by melting the outer end of the fiber. The surface tension of the molten glass rounds the tip into a hemisphere which can act like a lens and focus light. The rounded tips of the post also makes it easier to insert the post through the earlobe and into the bore 22.

Clearly, minor changes may be made in the form and construction of the invention without departing from the material spirit thereof. It is not, however, desired to confine the invention to the exact from herein shown and described, but it is desired to include all such as properly come within the scope claimed.

The invention having been thus described, what is claimed as new and desired to secure by Letters Patent is:

1. An electrical earring for use on a pierced earlobe, said earring comprising:

(a) a receptor portion for positioning on the outwardly facing surface of an earlobe, said receptor portion having a mounting body which has a bore, an inlet opening at one end of the bore and a light enhanced display element which is fixed to said body at the opposite end of said bore from said inlet opening, and (b) a transmitter portion for positioning on the inwardly facing surface of an earlobe, said transmitter portion having:

(1) a housing which has a cavity, (2) a battery within said cavity, (3) an electrical lamp within said cavity, said lamp being spaced from said battery, (4) electrical circuitry including switch means for selectively connecting said battery to said lamp for selectively illuminating said lamp, and (5) an elongated light transmitting post having a first end which is aligned with said lamp and a second end which extends from said housing so that when said housing is positioned on the inwardly facing surface of a pierced earlobe, the post extends through the earlobe and into the bore of said receptor portion so that said second end is adjacent said light enhanced display body for transmitting light to said body and enhancing said body.

2. An electrical earring as recited in claim 1, wherein said post is an optical fiber which includes a light carrying core, a cladding surrounding said core and at least one protective layer surrounding said cladding.

3. An electrical earring as recited in claim 2, wherein said protective layer is a thermoplastic material.

4. An electrical earring as recited in claim 1, wherein a lens is fixed to the second end of said post for focusing light from said second end to said display body.

5. An electrical earring as recited in claim 1, wherein a lens is located between said lamp and the first end of said post for focusing light from said lamp to said first end.

6. An electrical earring as recited in claim 1, wherein said lamp is a light emitting diode.

7. An electrical earring as recited in claim 1, wherein said housing has a removable cover and said battery is located adjacent said cover and is removably mounted in said housing for enabling the battery to be replaced by an identical battery.

8. An electrical earring as recited in claim 1, wherein said switch means comprises:

(a) a first contact which is operatively connected to one terminal of said battery, (b) a second contact which is operatively connected to the opposite terminal of said battery from said one terminal, and (c) an electrically conductive spring which is located outside of said housing between said housing and said receptor portion, said spring being operatively connected to said first contact and normally biased away from and out of engagement with said second contact, said spring being forced into engagement with said second contact when said receptor and transmitter portions are positioned on a person's earlobe so that said post enters the bore of said receptor portion for electrically connecting said battery to said lamp and thereby illuminating said lamp.

9. An electrical earring as recited in claim 8, further comprising a washer which is fixed to the end of the spring which is furthest from said housing for engaging the outwardly facing surface of an earlobe, said washer having a central aperture through which said post extends to enable said washer to move relative to said post along the central axis of the post when the spring is compressed.

* * * * *